US006608856B2

(12) United States Patent
Tanaka et al.

(10) Patent No.: US 6,608,856 B2
(45) Date of Patent: Aug. 19, 2003

(54) CRUCIBLE MELTING FURNACE

(75) Inventors: Akira Tanaka, Toyama-pref. (JP); Masaaki Kikura, Toyama-pref. (JP)

(73) Assignee: Hokuriku Techno Company Ltd., Toyama-pref. (JP)

( * ) Notice: Subject to any disclaimer, the term of this patent is extended or adjusted under 35 U.S.C. 154(b) by 0 days.

(21) Appl. No.: 09/984,849

(22) Filed: Oct. 31, 2001

(65) Prior Publication Data

US 2002/0080846 A1 Jun. 27, 2002

(30) Foreign Application Priority Data

Nov. 8, 2000 (JP) ..... 2000-341019

(51) Int. Cl.[7] ..... F27D 1/00; C22B 7/00

(52) U.S. Cl. ..... 373/71; 373/45; 373/109; 266/242; 219/420

(58) Field of Search ..... 373/71, 72, 45, 373/44, 109, 118, 119, 110; 219/399, 400, 405, 420, 421, 429, 430, 432; 432/158, 210, 196, 9, 247; 266/156, 242, 272; 110/336

(56) References Cited

U.S. PATENT DOCUMENTS

| | | | | | |
|---|---|---|---|---|---|
| 771,675 | A | * | 10/1904 | Smith | 266/242 |
| 3,459,414 | A | * | 8/1969 | Schmidt | 432/158 |
| 4,209,295 | A | * | 6/1980 | Frahme et al. | 110/336 |
| 4,455,016 | A | * | 6/1984 | Urdea | 266/156 |

* cited by examiner

*Primary Examiner*—Tu Ba Hoang
(74) *Attorney, Agent, or Firm*—Sughrue Mion, PLLC

(57) ABSTRACT

A crucible melting furnace has a feature it has a high thermal efficiency and that differences in temperature does not substantially occur in a molten metal within a crucible and can provide products of uniform quality. Moreover, the crucible melting furnace has a feature it does not substantially damage the crucible, and can prolong the life (serviceable life) of the crucible. The furnace has the crucible 1, and the thermal flow guide 10, defined around the crucible 1, which guides the thermal flow heating the crucible 1. The thermal flow guide 10 has the guide (protruded streak) 3 which guides the thermal flow along the spiral path around the crucible 1.

6 Claims, 2 Drawing Sheets

CRUCIBLE MELTING FURNACE

BACKGROUND OF THE INVENTION

The present invention relates to a crucible melting furnace, suitable in use for metal materials.

For example, crucible melting furnaces are used to cast products from non-iron metal materials such as aluminum. The crucible melting furnace generally has such a structure that a crucible is disposed inside a cylindrical furnace main body. A burner mounted below the crucible produces its flame toward the crucible.

In such a crucible melting furnace with the above construction, the flame from the burner is applied onto the bottom surface of the crucible at first. Next the flame climbs up along the side wall surfaces (outer circumference surfaces) of the crucible. However, the above-mentioned configuration has the following disadvantages.

(1) The flame applied to the bottom surface of the crucible rises up very quickly along the side wall surfaces of the crucible. Because of this construction, most of the heat energy is not utilized to fuse the metal material within the crucible. That is, the prior art furnace has a poor thermal efficiency.

(2) The flame is applied intensively to a specific portion of the crucible. For this reason, the temperature of a molten metal (a metal material in a liquid phase) within the crucible is considerably different from place to place. Such a phenomenon causes the quality of a product to be varied.

(3) As described in the item (2), the flame applied locally to a specific portion of the crucible tends to damage the specific portion. This results in shortening the life (serviceable life) of the crucible.

SUMMARY OF THE INVENTION

The present invention is made to solve the above-mentioned problems.

An object of the present invention is to provide a crucible melting furnace which has a high thermal efficiency and is capable of producing products with uniform quality and by which the temperature distribution of a molten metal within a crucible is small.

Moreover, another object of the present invention is to provide a crucible melting furnace which does not damage a crucible and can prolong the life (serviceable life) of the crucible.

In order to achieve the above-mentioned objects, according to the present invention, a crucible melting furnace comprises a crucible; and a thermal flow guide defined around the crucible, for guiding a thermal flow heating the crucible. The thermal flow guide has a guide for guiding the thermal flow along a spiral path defined around the crucible.

In the above-mentioned construction, the flame (thermal flow) produced by a burner are slowly carried away outside while being spirally rotated around the crucible along the outer circumference surfaces thereof. This structure largely increases the ratio of the heat energy used to fuse a metal material within the crucible, of the total heat energy of the flame (thermal flow). That is, the thermal efficiency is improved. Moreover, since the flame (thermal flow) does not intensively hit a specific portion of the crucible, it is hard that temperature differences occur in the molten metal within the crucible. This feature allows products with uniform quality to be obtained. Moreover, the above-mentioned structure does not substantially damage the crucible and can prolong the life (serviceable life) of the crucible.

The thermal flow guide can be comprised an outer circumference surface of the crucible and an annular fire-resistant wall disposed around the crucible. A spiral protruded streak formed on an inner circumference surface of the fire-resistant wall is utilized as the guide. As to the protruded streak, it is preferable that the width of the front end is shorter than that of the base end and that the cross section of the protruded streak has a trapezoid form. That is, by slanting the main surfaces (the upper surface and the lower surface) of the protruded streak, the thermal flow can be more effectively guided toward the crucible. As a result, the thermal efficiency can be improved.

Moreover, the ratio (a/b) of the height (a) of the protruded streak to the width (b) of the front end of the protruded streak is preferably 1.0 to 3.0, especially 1.5 to 2.5. That is, this range allows the thermal efficiency to be further improved and the life (serviceable life) of the crucible to be prolonged.

It is preferable that the fire-resistant wall comprises a composite material including a metal material and a ceramic material. With this structure, the protruded streak is difficult to be damaged due to heat and the life (serviceable life) of the crucible melting furnace is further prolonged.

BRIEF DESCRIPTION OF THE DRAWINGS

This and other objects, features and advantages of the present invention will become more apparent upon a reading of the following detailed description and drawings, in which.

DESCRIPTION OF THE EMBODIMENTS

Figure 1:
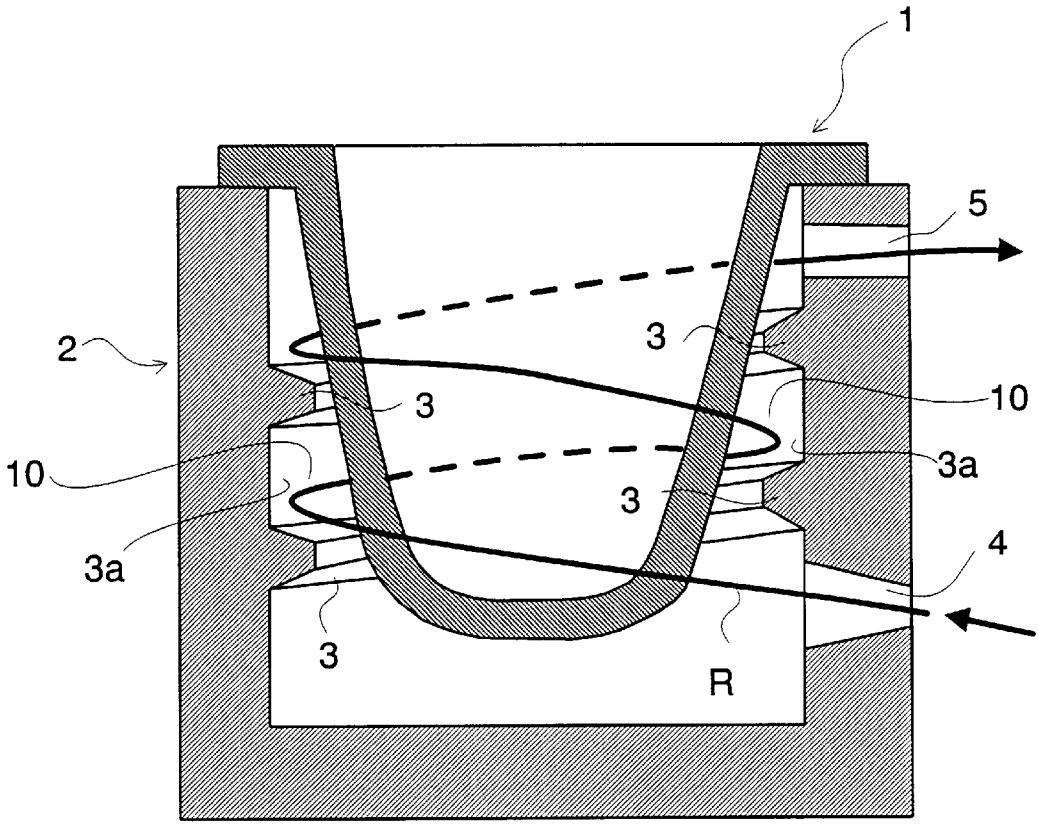
FIG. 1 is a schematic cross-sectional view illustrating a crucible melting furnace according to the present invention.
Figure 2:
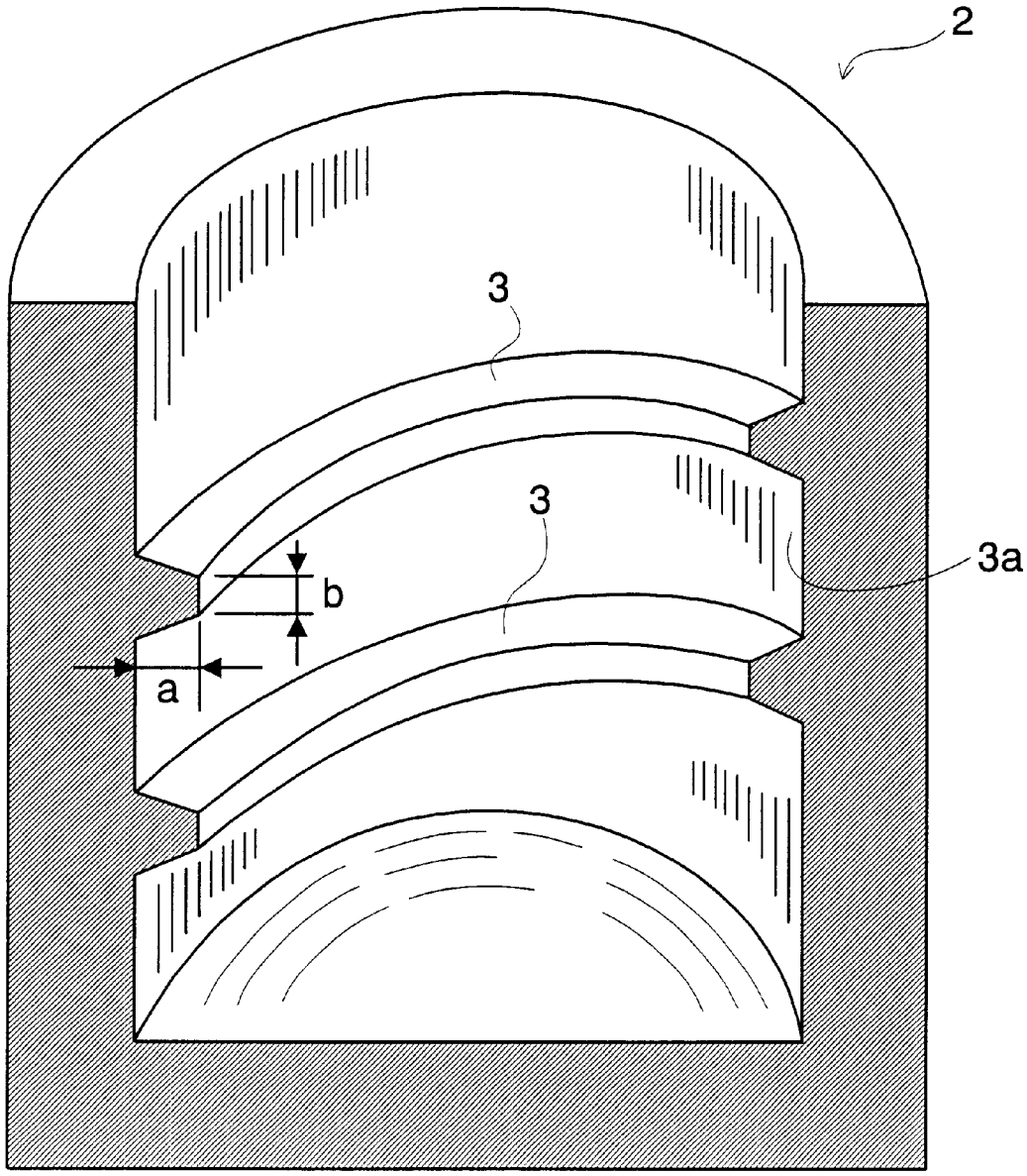
FIG. 2 is a cross-sectional view illustrating a fire-resistant wall constructing a crucible melting furnace according to the present invention.

A crucible melting furnace (referred to as furnace, hereinafter) of the present invention will be specifically described below by referring to FIGS. 1 and 2. FIG. 1 is a schematic cross-sectional view illustrating a furnace. FIG. 2 is a cross-sectional view illustrating a fire-resistant wall constructing the furnace.

Referring to FIG. 1, numeral 1 represents a crucible made of cast iron. The diameter (bore) of the crucible 1 is about 400 mm and the height is about 600 mm. In FIGS. 1 and 2, numeral 2 represents a fire-resistant wall. The crucible 1 is surrounded by the cylindrical fire-resistant wall 2, which has the bottom. Generally, the furnace is constructed of the crucible 1 and the fire-resistant wall 2.

The fire-resistant wall 2 is made of a firebrick formed of composite materials. The firebrick, for example, is made of a stainless steel chip of 0.4 mm in diameter and 30 mm in length and an alumina material (ceramic material).

The furnace has a thermal flow guide 10. The thermal flow guide 10, which is defined around the furnace 1, guides the thermal flow (flame) heating the furnace 1. In other words, the thermal flow guide 10 guides the thermal flow (flame) along the spiral path R defined around the crucible 1.

More specifically, the thermal flow guide 10 is formed of the outer circumference surface of the crucible 1 and the fire-resistant wall 2 disposed around the crucible 1. As shown in FIG. 2, the continuous spiral protruded streak 3 is formed in the inner circumference surface of the annular fire-resistant wall 2 (in more detail, a firebrick constructing the inner surface of the fire-resistant wall 2). The continuous spiral protruded streak 3 acts as the guide. That is, the guide, which guides the thermal flow (flame), is the protruded streak 3 formed spirally on the inner circumference surface of the fire-resistant wall 2.

The protruded streak 3 has the cross section having a trapezoid form. The width of the front end of the protruded streak 3 is shorter than that of the base end thereof. In the protruded streak 3, the ratio (a/b) of the protrusion height (a) of the protruded streak 3 to the width (b) of the front end thereof is 1.0 to 3.0.

With the furnace having the above-mentioned structure, the flame emitted from a burner (not shown) is introduced into the furnace through the hole 4 in the fire-resistant wall 2. The flame, or thermal flow, is guided through grooves 3*a* between the protruded streaks 3 vertically arranged and rises up vertically and spirally around the crucible 1. That is, the flame from the burner is slowly exhausted out through the hole 5 in the fire-resistant wall 2 while spirally advancing along the outer circumference surface around the crucible 1.

For that reason, of the total heat energy of the flame, the ratio of the heat energy to be consumed to fuse the metal material (not shown) within the crucible 1 increases remarkably. That is, the thermal efficiency increases. Moreover, since the flame does not heat locally only a specific portion of the crucible 1, it is hard that differences in temperature occur in the molten metal within the crucible 1. This feature allows products with uniform quality to be manufactured. Moreover, because of the same reason, it can be avoided that the crucible 1 is damaged so that the life (serviceable life) thereof is prolonged.

Using the crucible melting furnace with the above-mentioned structure, a pure aluminum of a purity of 99.5% was subjected to a fusion test. Table I shows the results.

TABLE I

| a/b | Melting time (hour) | Fuel efficiency (kcal/hour) | Total heat quantity (kcal) | Life | Total evaluation |
|---|---|---|---|---|---|
| 2.5 | 2.4 | $131 \times 10^3$ | $314.4 \times 10^3$ | 1.3 | ○ |
| 2.0 | 2.6 | $155 \times 10^3$ | $403.0 \times 10^3$ | 1.5 | ◎ |
| 1.5 | 3.1 | $178 \times 10^3$ | $551.8 \times 10^3$ | 1.4 | ○ |
| 1.0 | 3.5 | $210 \times 10^3$ | $735.0 \times 10^3$ | 1.2 | ○–Δ |
| 0.5 | 3.8 | $217 \times 10^3$ | $824.6 \times 10^3$ | 1.1 | Δ |
| 0.0 | 4.0 | $232 \times 10^3$ | $928.0 \times 10^3$ | 1 | x |

Here when the ratio (a/b) is 0, the furnace does not have the protruded streak (that is, the furnace is a prior-art furnace). The life (serviceable life) of a crucible is expressed as a relative value when the life (serviceable life) of a furnace is defined as 1, with the ratio (a/b) of 0. Here, 1 kcal is equal to about 4.2 kJ.

Next, using the crucible melting furnace with the carbon crucible instead of the cast-iron crucible (other structure is similar to that in the previous embodiment), a brass (Cu: 60%, Zn: 40%) is subjected to a fusion test. Table II shows the results.

TABLE II

| a/b | Melting time (hour) | Fuel efficiency (kcal/hour) | Total heat quantity (kcal) | Life | Total evaluation |
|---|---|---|---|---|---|
| 2.5 | 2.6 | $145 \times 10^3$ | $377.0 \times 10^3$ | 1.3 | ○ |
| 2.0 | 2.8 | $160 \times 10^3$ | $448.0 \times 10^3$ | 1.5 | ◎ |
| 1.5 | 3.8 | $195 \times 10^3$ | $643.5 \times 10^3$ | 1.4 | ○ |
| 1.0 | 3.8 | $220 \times 10^3$ | $836.0 \times 10^3$ | 1.2 | ○–Δ |
| 0.5 | 4.0 | $241 \times 10^3$ | $964.0 \times 10^3$ | 1.1 | Δ |
| 0.0 | 4.5 | $263 \times 10^3$ | $1183.5 \times 10^3$ | 1 | x |

Here, when the ratio (a/b) is 0, the furnace does not have the protruded streak (that is, corresponds to a prior-art furnace). The life (serviceable life) of the crucible is expressed as a relative value when the life (serviceable life) of the furnace is defined as 1, with the ratio (a/b) of 0.

The following facts are found from the results listed in Tables I and II.

First, when the furnace has a guide spirally guiding the thermal flow, particularly has a spiral protruded streak formed on the fire-resistant wall disposed around the crucible, the time period, fuel efficiency, or heat quantity, required to fuse the metal material, is reduced and is economical.

Moreover, the use of the above-mentioned structure leads to a long life (serviceable life) of the crucible. This feature become remarkable when the ratio (a/b) of the height (a) of the protruded streak to the width (b) of the front end of the protruded streak is 1.0 to 3.0, especially 1.5 to 2.5.

Moreover, with the fire-resistant wall disposed around the crucible formed of a composite material including a metal material and a ceramic material, the fact that the thermal damage is small was found. In more detail, the amount of the stainless steel chip contained in the firebrick constructing the fire-resistant wall was increased or decreased. The bending strength of each firebrick was examined at 1300° C. With the content of the stainless steel chip being 0 mass %, the bending strength is 5 MPa. With 1 mass %, the bending strength is 18 MPa. With 2 mass %, the bending strength is 32 MPa. With 3 mass %, the bending strength is 30 MPa. With 4 mass %, the bending strength is 23 MPa. This proves that the fire-resistant wall formed of a ceramic composite material containing a metal material of 0.5 to 5 mass %, particularly, of 1.5 to 4.0 mass % provides small thermal damage, thus improving the durability of the furnace.

The crucible melting furnace of the present invention has a high thermal efficiency and has the property in which temperature differences do not easily occur in a molten metal within the crucible and can provide products with uniform quality. Further the crucible melting furnace of the present invention does not substantially damage the crucible and can prolong the life (serviceable life) of the crucible.

What is claimed is:

1. A crucible melting furnace comprising:

a crucible; and a thermal flow guide defined around said crucible, for guiding a thermal flow heating said crucible;

said thermal flow guide having a guide for guiding said thermal flow along a spiral path defined around said crucible, wherein:

said thermal flow guide comprises an outer circumference surface of said crucible and an annular fire-resistant wall disposed around said crucible; and wherein said guide has a spiral protruded streak formed on an inner circumference surface of said fire-resistant wall, and said protruded streak has a front end and a base end, the width of said front end being shorter than that of the base end, the cross section of said protruded streak having a trapezoid form.

2. The crucible melting furnace defined in claim 1, wherein the ratio (a/b) of the height (a) of said protruded streak to the width (b) of said front end of said protruded streak is 1 to 3.

3. The crucible melting furnace defined in claim 2; wherein said fire-resistant wall comprises a composite material including a metal material and a ceramic material.

4. The crucible melting furnace defined in claim 1, wherein said fire-resistant wall comprises a composite material including a metal material and a ceramic material.

5. A crucible melting furnace comprising:

a crucible; and a thermal flow guide defined around said crucible, for guiding a thermal flow heating said crucible;

said thermal flow guide having a guide for guiding said thermal flow along a spiral path defined around said crucible, wherein:

said thermal flow guide comprises an outer circumference surface of said crucible and an annular fire-resistant wall disposed around said crucible; and wherein said guide has a spiral protruded streak formed on an inner circumference surface of said fire-resistant wall; and the ratio (a/b) of a height (a) of said protruded streak to a width (b) of a front end of said protruded streak is 1 to 3.

6. The crucible melting furnace defined in claim 5, wherein said fire-resistant wall comprises a composite material including a metal material and a ceramic material.

* * * * *